US006868991B2

(12) United States Patent
Kuhn et al.

(10) Patent No.: US 6,868,991 B2
(45) Date of Patent: Mar. 22, 2005

(54) SQUEEZE LIQUID DISPENSER

(75) Inventors: Petrus Henricus A. N. Kuhn, Den Haag (NL); Wander Herman Colenbrander, Den Haag (NL)

(73) Assignee: Sara Lee/DE N.V. (NL)

( * ) Notice: Subject to any disclaimer, the term of this patent is extended or adjusted under 35 U.S.C. 154(b) by 0 days.

(21) Appl. No.: 10/433,213

(22) PCT Filed: Dec. 3, 2001

(86) PCT No.: PCT/NL01/00878

§ 371 (c)(1),
(2), (4) Date: Nov. 3, 2003

(87) PCT Pub. No.: WO02/44049

PCT Pub. Date: Jun. 6, 2002

(65) Prior Publication Data

US 2004/0074924 A1 Apr. 22, 2004

(30) Foreign Application Priority Data

Dec. 1, 2000 (NL) ..... 1016774

(51) Int. Cl.[7] ..... B65D 47/20
(52) U.S. Cl. ..... 222/212; 222/482
(58) Field of Search ..... 222/207, 211, 222/212, 215, 481.5, 482

(56) References Cited

U.S. PATENT DOCUMENTS 3,705,668 A * 12/1972 Schwartzman ..... 222/213
3,963,150 A * 6/1976 Steiman et al. ..... 222/211
4,087,023 A * 5/1978 Szczepanski ..... 222/212
4,147,306 A * 4/1979 Bennett ..... 222/212
4,607,762 A * 8/1986 Zulauf et al. ..... 222/212
4,615,467 A * 10/1986 Grogan et al. ..... 222/211
5,240,149 A * 8/1993 Schmidt ..... 222/212
5,301,845 A * 4/1994 Labonte ..... 222/211

FOREIGN PATENT DOCUMENTS

| | | |
|---|---|---|
| DE | 7604143 | 5/1979 |
| DE | 9004674 | 6/1990 |
| DE | 9200245 | 4/1992 |
| EP | 0011394 | 5/1980 |
| GB | 2198418 | 6/1988 |

* cited by examiner

*Primary Examiner*—Kenneth Bomberg
(74) *Attorney, Agent, or Firm*—Altera Law Group, LLC

(57) ABSTRACT

A squeeze dispenser for liquids, preferably relatively highly viscous liquids, is provided with a flexible holder (1) with an outflow opening (2) via which a liquid can be pressed out of the holder, and with a sealing element (3) arranged over this outflow opening. In this sealing element, a first valve (12) is arranged via which, when the holder is squeezed, liquid can be pressed out of the holder, as well as a second valve (18) for admitting air into the holder when the holder is no longer squeezed.

9 Claims, 3 Drawing Sheets

SQUEEZE LIQUID DISPENSER

The present invention relates to a squeeze dispenser for liquids, preferably relatively highly viscous liquids, provided with a flexible holder having an outflow opening via which a liquid can be pressed out of the holder, and with a sealing element arranged over this outflow opening, wherein in this sealing element a first valve is arranged via which, when the holder is squeezed, liquid can be pressed out of the holder, as well as a second valve for admitting air into the holder when the holder is no longer squeezed.

Such a dispenser is known from GB-A-2 198 418 and is used for pressing a liquid out of a holder by squeezing this holder and deforming it, while the holder is held with the outflow opening facing downwards, whereupon, subsequently, air is let into the dispenser to undo the deformation.

The disadvantage of the known dispenser is that, when the squeezing of the dispenser is stopped while the dispenser is still in the position with the outflow opening directed downwards, the outflow of liquid will stop but air can only slowly flow into the dispenser, against the pressure of the liquid, resulting in the deformation of the holder being undone only slowly, so that one has to wait longer before a next squeeze of the holder for squeezing out liquid can be effected. This disadvantage becomes greater according as the liquid is more viscous.

The object of the present invention is a squeeze dispenser for high viscous liquids without the abovementioned problems. The squeeze dispenser of the preamble is characterized according to the invention in that the holder is provided with a riser, one end of which terminates in the first valve, in addition to the first valve a ball being provided in the extremity of the riser located adjacent the first valve, which can close off the riser.

With the dispenser according to the invention, the dispenser is squeezed in the upright position because of the presence of the riser. When the squeezing of the holder is stopped and the first valve closes, the liquid will remain in this riser, so that upon a subsequent squeezing of the holder, liquid can be dispensed directly. To provide that, after stopping the squeezing movement, due to the slowness of the first valve, air still ends up in the top of the riser and thus the riser does not remain completely filled, the said ball is provided in the extremity of the riser adjacent the first valve, which can close off the riser. Consequently, when squeezing the dispenser again, liquid will be dispensed directly because the riser will be substantially completely filled with liquid.

For constructional reasons, the second valve cannot always be located directly adjacent the first valve. Therefore, also according to the invention, the first valve can be active in a surface of the scaling element perpendicular to the outflow direction of the liquid from the holder, and the second valve can be active in a side surface of the sealing element. In particular, the surface in which the second valve is active can be substantially perpendicular to that in which the first valve is active.

In a more concrete embodiment, the sealing element comprises a first closing part which can be secured to the holder and a second closing part which can be secured over the first closing part, the second closing part comprising at least partly a flexible part which, together with the first closing part, forms the first valve. Then, it is favorable when at least the upper part of the riser forms part of the first closing part and the extremity of the riser is located opposite the flexible part mentioned. The second valve can be formed by a lip which is active between the two closing parts. The first closing part can then be provided with at least one opening, via which air, let through by the second valve, can flow into the holder.

To block a liquid flow to the space between the first and second closing part, via which air, let through by the second valve, can flow to the above-mentioned opening in the first closing part, it is favorable when a sealing lip is present between the two closing parts.

With a view to cost price-favorable manufacture, the holder and the two closing parts can be manufactured from plastic by injection molding, while the plastic material of the second closing part is softer than that of the holder and the first closing part.

It should be noted that DE-U-76 04 143 discloses a squeeze dispenser with a riser and a ball for closing off the riser.

The invention will presently be further elucidated with reference to an exemplary embodiment represented in the accompanying drawing. It this drawing.

Figure 1:
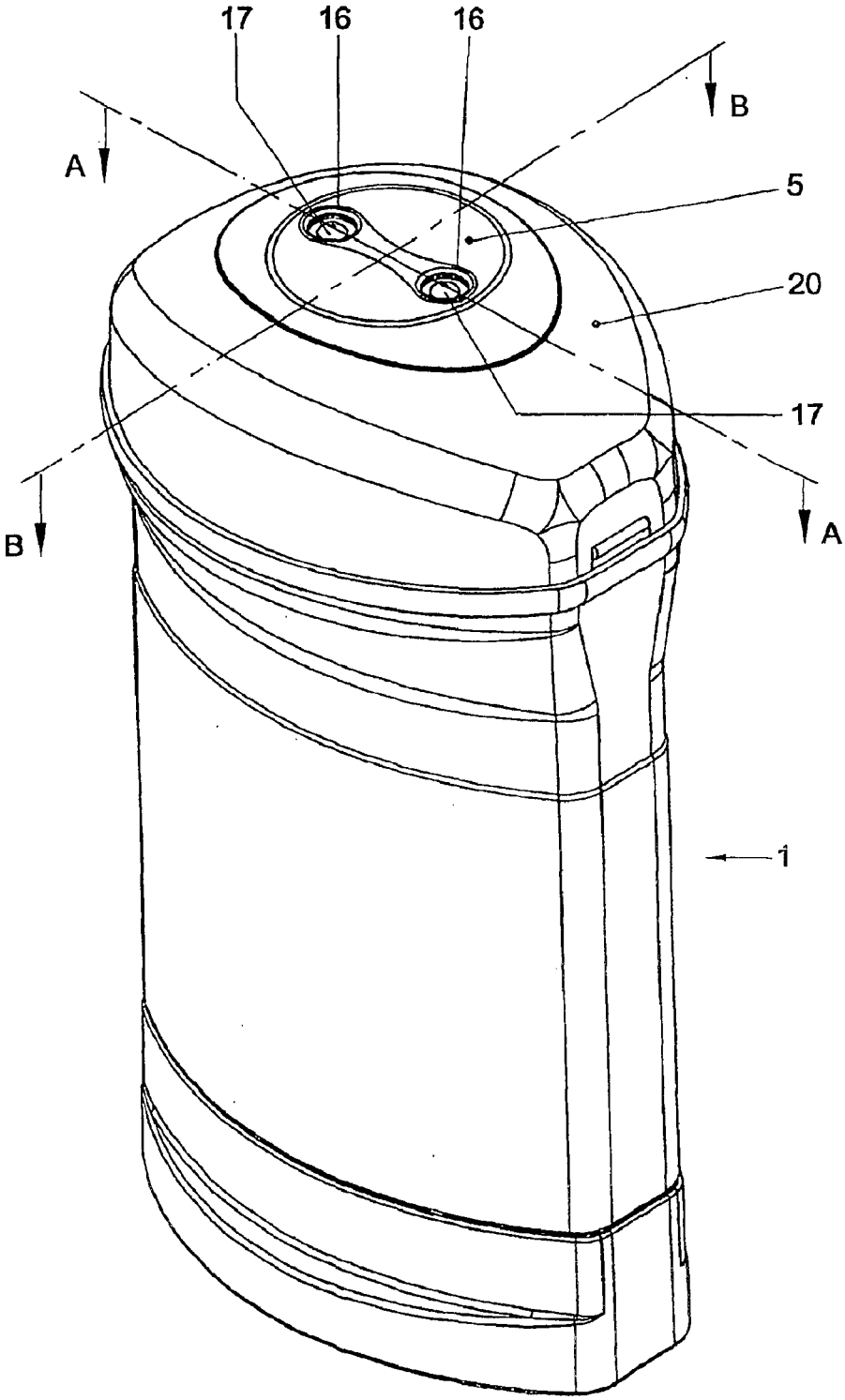
FIG. 1 shows a perspective image of a dispenser according to the invention.
Figure 2:
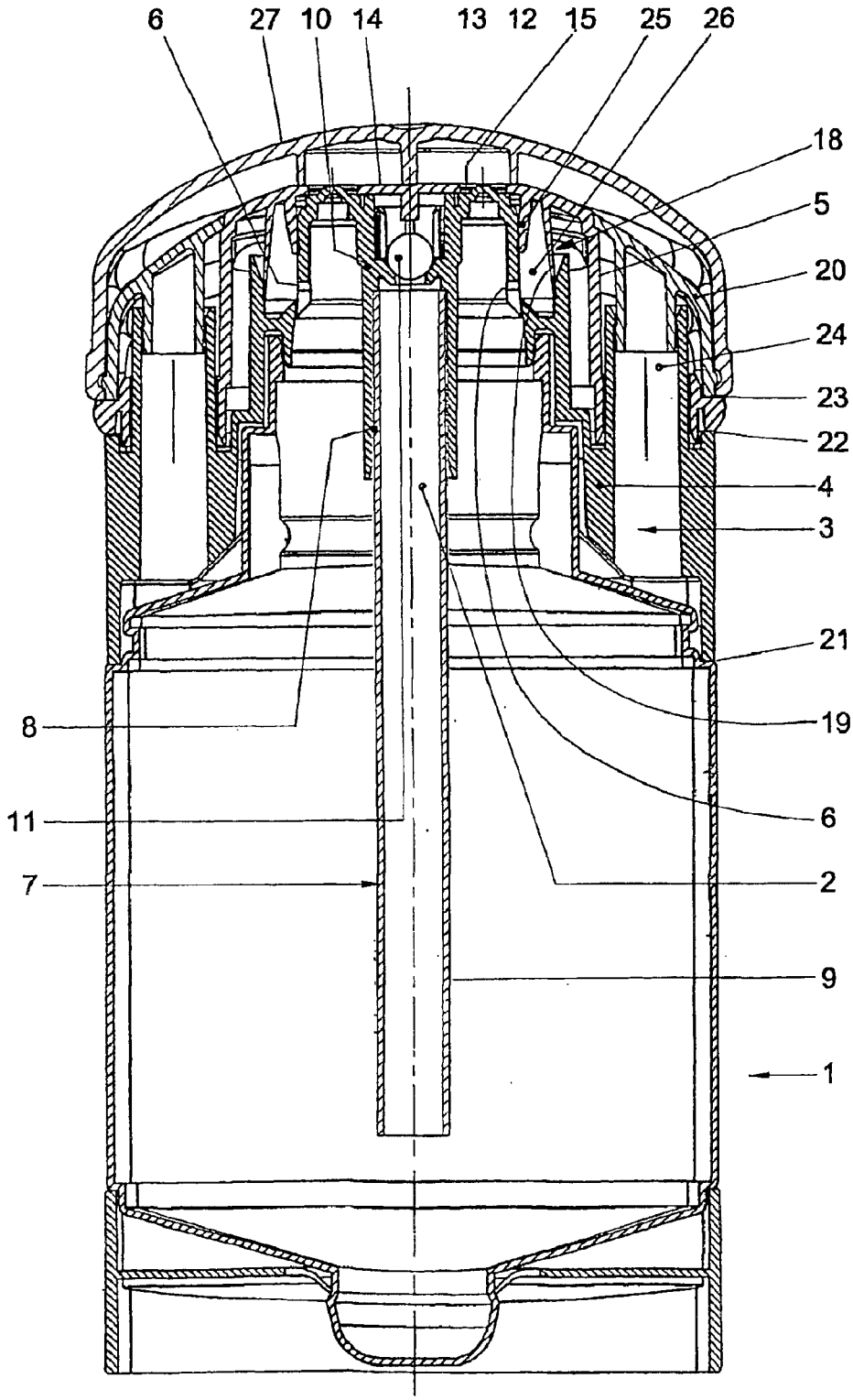
FIG. 2 shows a cross section along the plane A—A of FIG. 1.
Figure 3:
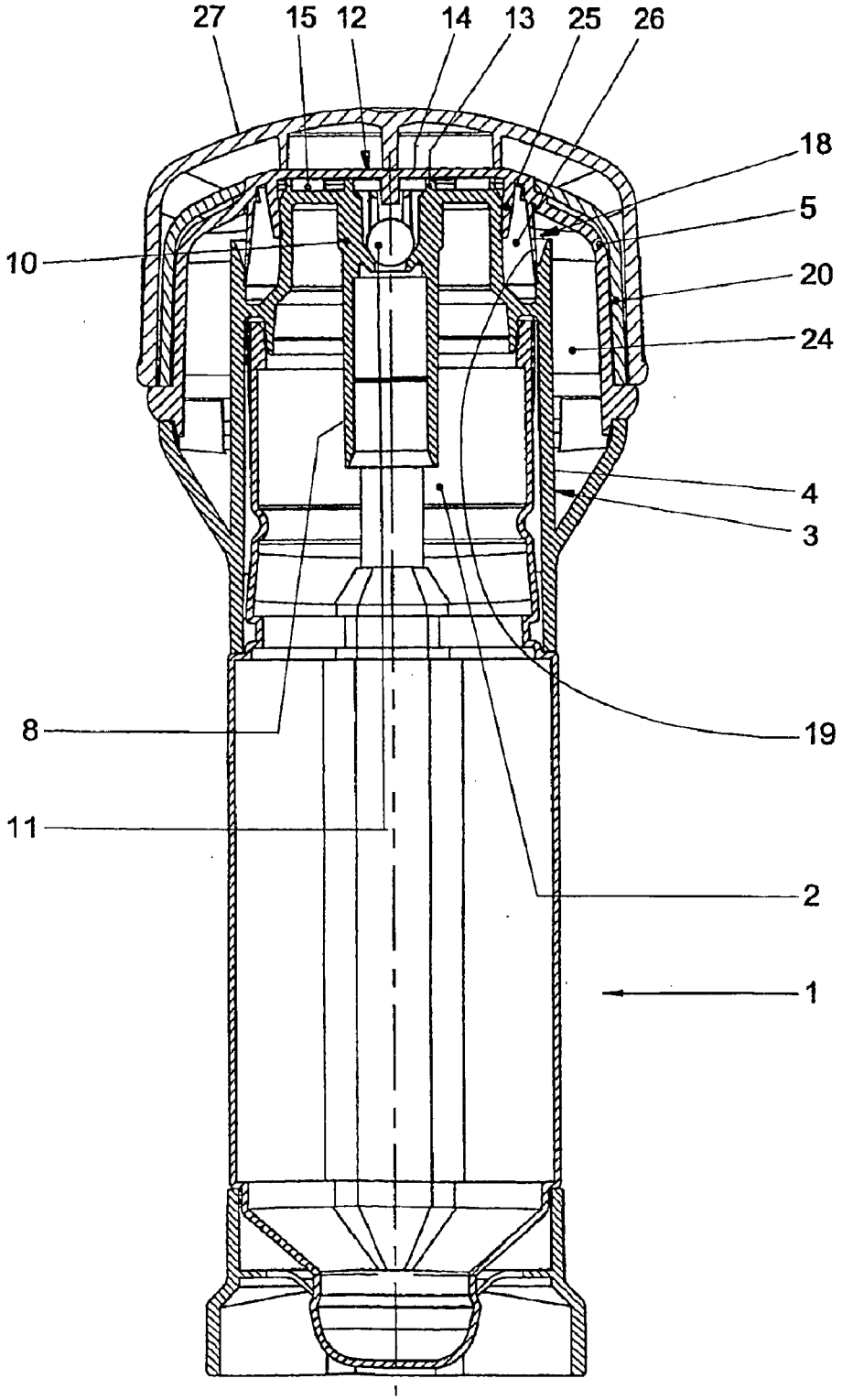
FIG. 3 shows a cross section along the plane B—B of FIG. 1.

The bottle dispenser depicted in the Figures comprises a flexible liquid holder 1 with an outflow opening 2 and a sealing element 3 arranged over this outflow opening. The sealing element 3 consists of a first closing part 4 which can be secured on the holder 1, and a second closing part 5 which can be secured over the first closing part. The holder 1 and the two closing parts 4 and 5 are manufactured from plastic by injection molding, the plastic material of the second closing part 5 being softer than that of the holder 1 and the first closing part 4. The first closing part 4 is provided with two openings 6, via which air can flow into the holder. In the holder 1 a riser 7 is present, extending centrally through the dispenser, the upper portion 8 of which forms part of the first closing part 4. The lower and larger portion 9 of this riser can be inserted in the upper portion 8 thereof. In the upper portion 8 of the riser 7, a constriction 10 has been provided, above which a ball 11 is located.

The bottle dispenser is provided with a first valve 12, formed by the upper edges 13 of the upper portion 8 of the riser 7 and the center face 14 of the second closing part 5. The first valve 12 is active in a surface perpendicular to the central axis of the dispenser. By squeezing the holder 1, with the aid of this valve 12, liquid can be pressed out of the holder 1 via the riser 7 and through the constriction 10 along the ball 11, thereby pushed upwards, between the edges 13 and the center face 14 mentioned, beyond the first closing part 5 into an annular space 15 and from there to outflow openings 16 in the second closing part. Normally, those outflow openings 16 are closed off by a projection 17 on the first closing part, but are opened under pressure of the liquid pressed out. The outflow openings are located sideways relative to the first valve 12.

The bottle dispenser is further provided with a second valve 18, formed by a lip 19 being part of the second closing part 5, which lip is active between the two sealing parts 4 and 6. This second valve 18 is active in a side surface of the sealing element 3, more specifically in a surface substantially perpendicular to that in which the first valve 12 is active. Via this second valve 18 and the openings 6, air can be sucked into the holder 1 when the squeezing thereof is undone. Sideways around the first and second closing part, an annular casing 20 is provided. The outer closure 21 between the holder 1 and the first closing part 4, the outer closure 22 between the first and second closing parts 4 and 5 and the closure 23 between the annular casing 20 and the second closing part 5 is such that therethrough, via the space 24, air can be sucked to the second valve 18.

Additionally, a further lip 25, forming part of the second closing part, is present for blocking a liquid flow to the space 26 between the first and second closing part. Further, the holder 1 with the two closing parts 4 and 5 can be covered by a removable cover 27.

As already mentioned, when the holder 1 is squeezed, liquid is pressed out via the riser 7 and the first valve 12, while, when squeezing is stopped, the valve 12 closes itself, the ball 11 falls back onto the constriction 10 and air is sucked into the holder via the second valve 18 and the openings 6, so that liquid remains in the riser and, consequently, upon a subsequent squeezing of the holder, can be rapidly pressed out. If the first valve were to close rapidly, hardly any air would come into the top of the riser via this valve, and the ball 11 is superfluous. However, the rate at which the valve 12 closes is highly dependent on the material of the second closing part, in particular of the center face 14.

The invention is not limited to the embodiment described here with reference to the figures but comprises all sorts of modifications thereon, naturally insofar as these fall within the scope of protection of the following claims.

What is claimed is:

1. A squeeze dispenser for highly viscous liquid having a flexible holder, the holder comprising:

a sealing element;

an outflow opening covered by the sealing element, wherein highly viscous liquid is pressed out of the flexible holder through the outflow opening;

a first valve covered by the sealing element, wherein highly viscous liquid is pressed out of the flexible holder through the first valve when the holder is squeezed the first valve normally closed but is opened under pressure of the highly viscous liquid as it is squeezed out;

a second valve covered by the sealing element, wherein air is admitted into the flexible holder through the second valve when the holder is released;

a riser having a terminal end, the terminal end terminating in the first valve; and a ball disposed in the terminal end of the riser adjacent the first valve, wherein when the holder is released the ball blocks the first valve and air is sucked into the second valve.

2. A squeeze dispenser according to claim 1, wherein the first valve is active in a surface of the sealing element perpendicular to the outflow direction of the liquid from the holder and the second valve is active in a side surface of the sealing element.

3. A squeeze dispenser according to claim 1, wherein the sealing element comprises a first closing part which can be secured on the holder and a second closing part which can be secured over the first closing part, the second closing part comprising at least partly a flexible part which, together with the first closing part, forms the first valve.

4. A squeeze dispenser according to claim 3, wherein at least the upper portion of the riser forms part of the first closing part and the extremity of the riser is situated opposite said flexible part.

5. A squeeze dispenser according to claim 3, wherein the second valve is formed by a lip which is active between the two closing parts.

6. A squeeze dispenser according to claim 3, wherein the holder and the two closing parts are manufactured from plastic by injection molding, the plastic material of the second closing part being softer than that of the holder and the first closing part.

7. A squeeze dispenser for liquids, preferably relatively highly viscous liquids, provided with a flexible holder with an outflow opening via which a liquid can be pressed out of the holder, and with a sealing element arranged over this outflow opening, wherein in this sealing element a first valve is arranged via which, when the holder is squeezed, liquid can be pressed out of the holder, as well as a second valve for admitting air into the holder when the holder is no longer squeezed, wherein the holder provided with a riser, one end of which terminates in the first valve, in addition to the first valve a ball being provided in the extremity of the riser located adjacent the first valve, which can close off the riser, wherein the sealing element comprises a first closing part which can be secured on the holder and a second closing part which can be secured over the first closing part, the second closing part comprising at least partly a flexible part which, together with the first closing part, forms the first valve, wherein the second valve is formed by a lip which is active between the two closing parts, and wherein the first closing part is provided with at least one opening, via which air, let through by the second valve, can flow into the holder.

8. A squeeze dispenser for liquids, preferably relatively highly viscous liquids, provided with a flexible holder with an outflow opening via which a liquid can be pressed out of the holder, and with a sealing element arranged over this outflow opening, wherein in this sealing element a first valve is arranged via which, when the holder is squeezed, liquid can be pressed out of the holder, as well as a second valve for admitting air into the holder when the holder is no longer squeezed, wherein the holder provided with a riser, one end of which terminates in the first valve, in addition to the first valve a ball being provided in the extremity of the riser located adjacent the first valve, which can close off the riser, wherein the sealing element comprises a first closing part which can be secured on the holder and a second closing part which can be secured over the first closing part, the second closing part comprising at least partly a flexible part which, together with the first closing part, forms the first valve, and wherein a sealing lip is present for blocking a liquid flow to the space between the first and second closing part via which air, let through by the second valve, can flow to said opening in the first closing part.

9. A squeeze dispenser for liquids, preferably relatively highly viscous liquids, provided with a flexible holder with an outflow opening via which a liquid can be pressed out of the holder, and with a sealing element arranged over this outflow opening, wherein in this sealing element a first valve is arranged via which, when the holder is squeezed, liquid can be pressed out of the holder, as well as a second valve for admitting air into the holder when the holder is no longer squeezed, wherein the holder provided with a riser, one end of which terminates in the first valve, in addition to the first valve a ball being provided in the extremity of the riser located adjacent the first valve, which can close off the riser, wherein the first valve is active in a surface of the sealing element perpendicular to the outflow direction of the liquid from the holder and the second valve is active in a side surface of the sealing element, and wherein the plane in which the second valve is active is substantially perpendicular to that in which the first valve is active.

* * * * *